US005904408A

United States Patent [19]

Olson et al.

[11] Patent Number: 5,904,408

[45] Date of Patent: May 18, 1999

[54] ROTARY CUTTER AND MOUNTING ARRANGEMENT FOR CUTTING TOOLS

[75] Inventors: Thomas J. Olson, Dayton; Donald J. Swanson, Elk River, both of Minn.

[73] Assignee: Caterpillar Paving Products Inc., Minneapolis, Minn.

[21] Appl. No.: 08/899,973

[22] Filed: Jul. 24, 1997

[51] Int. Cl.[6] ..... E21C 35/193

[52] U.S. Cl. ..... 299/87.1; 299/102

[58] Field of Search ..... 299/87.1, 102, 299/106

[56] References Cited

U.S. PATENT DOCUMENTS

| | | | |
|---|---|---|---|
| 3,614,164 | 10/1971 | Davis | 299/83.1 |
| 3,749,449 | 7/1973 | Krekeler | 299/102 |
| 4,057,294 | 11/1977 | Krekeler | 299/102 |
| 4,068,897 | 1/1978 | Amoroso | 299/102 |
| 4,275,929 | 6/1981 | Krekeler | 299/102 |
| 4,371,210 | 2/1983 | Liebee | 299/10 |
| 4,415,208 | 11/1983 | Goyarts | 299/102 |
| 5,078,540 | 1/1992 | Jakob et al. | 404/90 |
| 5,322,351 | 6/1994 | Lent | 299/102 |
| 5,573,308 | 11/1996 | Simmons et al. | 299/102 |

FOREIGN PATENT DOCUMENTS

| | | |
|---|---|---|
| 3611446 | 11/1987 | Germany . |
| 2644992 | 12/1987 | Germany . |
| 2230289 | 11/1990 | United Kingdom . |

*Primary Examiner*—David J. Bagnell
*Attorney, Agent, or Firm*—Steven G. Kibby; Robert Muir

[57] ABSTRACT

A rotary cutter having a plurality of flights each having a tool holder receiving pocket extending radially inwardly from an outer surface of the flight. Each receiving pocket has a mounting socket at the innermost portion of the pocket which securely positions a tool holder, the tool holder being retained in the socket by a fastener.

4 Claims, 4 Drawing Sheets

ROTARY CUTTER AND MOUNTING ARRANGEMENT FOR CUTTING TOOLS

DESCRIPTION

1. Technical Field

This invention relates generally to a rotary cutter, and more particularly to a rotary cutter having a plurality of cutting tools circumferentially disposed about, and in spaced relationship from, the surface of a rotating drum.

2. Background Art

Rotary cutters of the type used on roadway planers, also known as pavement profilers, road milling machines or cold planers, and on road reclaiming or scarifying machines, are well known in the art. An example of such rotary cutters is disclosed in British Patent Application No. 2,230,289A, published Oct. 17, 1990. The British publication discloses a rotary cutter having a plurality of cutting tools mounted in tool holders that are bolted to the flighting forming a spiral conveyor about the surface of a rotatable drum. The tool holders are secured to the flighting by screws that are threaded into threaded holes in the body of the tool holder. Another example of a rotary cutter and mounting arrangement for cutting tools is disclosed in U.S. Pat. No. 5,322,351, issued to Lent on Jun. 21, 1994. There, a rotary cutter is taught having a plurality of flighting segments which have a tool holder receiving pocket. Cutting tool holders are retained in the pocket by a wedge and a bolt extending through the wedge. Other prior art arrangements secure the tool holders by screws, or bolts, threaded into holes provided in the drum surface or by welding the tool holder to the drum surface. A problem with rotary cutters is that flighting segments, or flights, and associated tool holders should securely hold the cutting tools at predetermined angles and be economically produced. While economical solutions are proposed in the prior art, more durable, easily repairable and economical flights and tool holders are desired.

The present invention is directed to overcoming one or more of the problems set forth above.

DISCLOSURE OF THE INVENTION

In accordance with one aspect of the present invention, a rotary cutter includes a rotatable drum having a plurality of flights that are attached to the drum outer surface. Each flight has forward and rearward wall surfaces which are matingly engaged with corresponding surfaces on abutting flights. Each flight has inner and outer radially spaced wall surfaces and a tool holder receiving pocket extending radially inwardly from the outer wall surface. A tool holder mounting socket is at the innermost part of the tool holder receiving pocket. Each flight has a pair of side walls extending radially outwardly from the inner to the outer wall surface with at least one of the side walls defining a material conveying surface. A passage extends between the side walls, and an opening extends radially inwardly from the tool holder receiving pocket to the passage. A tool holder is closely received in the tool holder mounting socket. The tool holder has a forward portion relative to the rotation of the drum with a fastener-receiving hole. This hole is disposed above the opening in flight and a fastener passes through the flight opening and the holder hole.

In another aspect, a flight for a rotary cutter includes forward and rearward end wall surfaces each adapted to be matingly engaged with a corresponding surface on an adjacent flight. The flight has inner and outer spaced wall surfaces, with a tool holder receiving pocket extending inwardly from the outer wall surface. At the innermost part of the receiving pocket is a tool holder mounting socket having generally parallel socket side walls and arcuate socket end walls. The flight also has a pair of side walls extending outwardly from the inner wall surface to the outer wall surface, with one wall of said pair of side walls defining a material conveying surface. A passage extends between the pair of side walls, and an opening extends from the tool holder mounting socket to the passage. The flight has a wedge-shaped boss at the intersection of the rearward end wall surface and the outer wall surface and a beveled edge at the intersection of the forward end wall surface and the outer wall surface.

In yet another aspect of the present invention, a tool holder includes a body having generally parallel side portions and arcuate end portions. The tool holder has an upstanding boss on the body and an inclined cylindrical shaft for receiving a replaceable cutting tool and holding the cutting tool's cutting end spaced from the body. The body has a fastener-receiving hole extending through the cutting end.

The invention is illustrated in the attached drawings which are herein described.

BEST MODE FOR CARRYING OUT THE INVENTION

Figure 1:
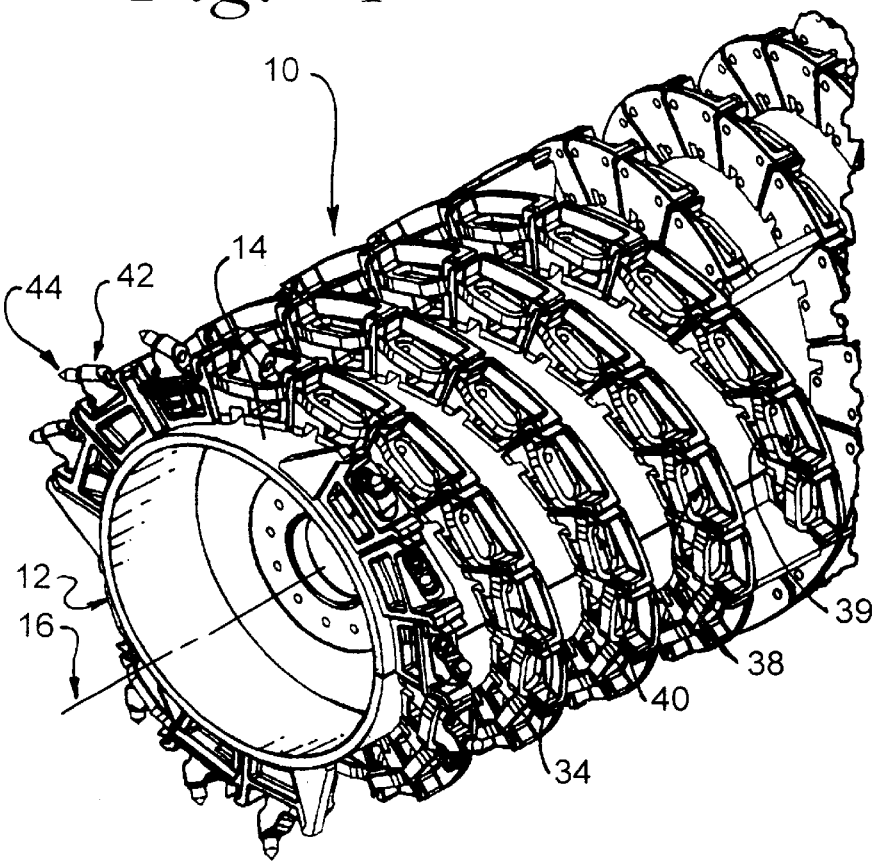
FIG. 1 is a perspective view of a portion of a rotary cutter showing an embodiment of the present invention.
Figure 5:
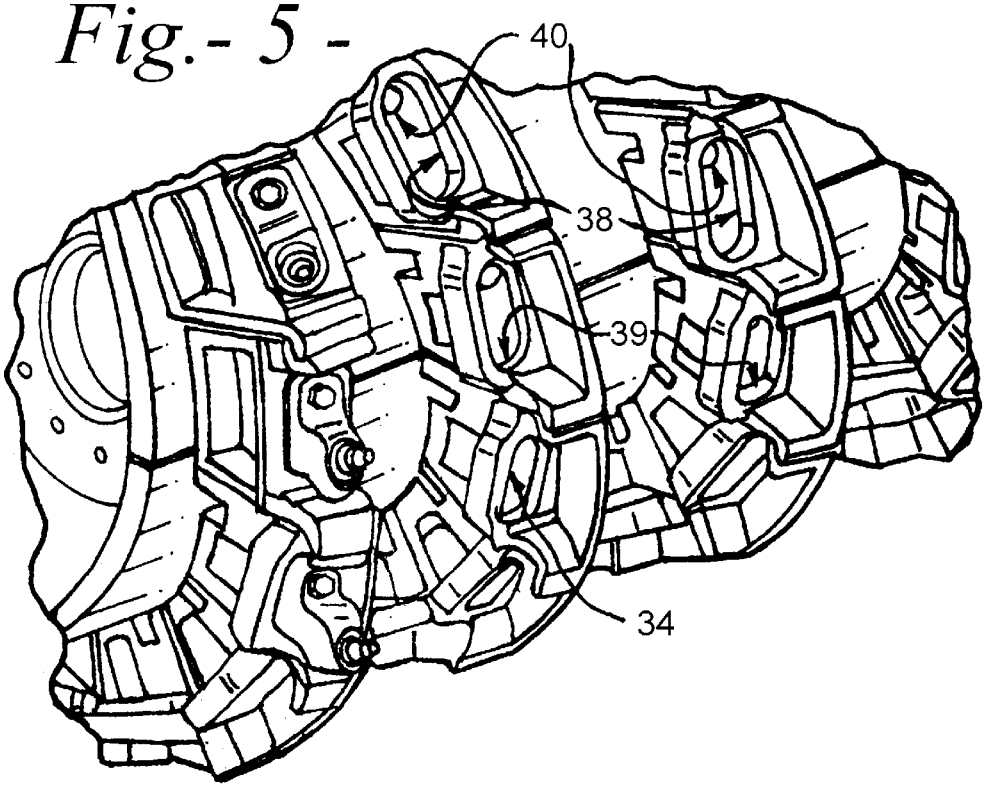
FIG. 5 is an enlarged view of the lower right portion of FIG. 1.

A partial rotary cutter 10 of the type suitable for use on roadway milling, planing or reclamation machines, is shown in FIGS. 1 and 5. Conventionally, the rotary cutter 10 includes a drum 12 having an outer surface 14. The drum 12 is rotatable about a longitudinal axis 16 that is customarily disposed parallel to the ground or roadway surface being cut.

Figure 2:
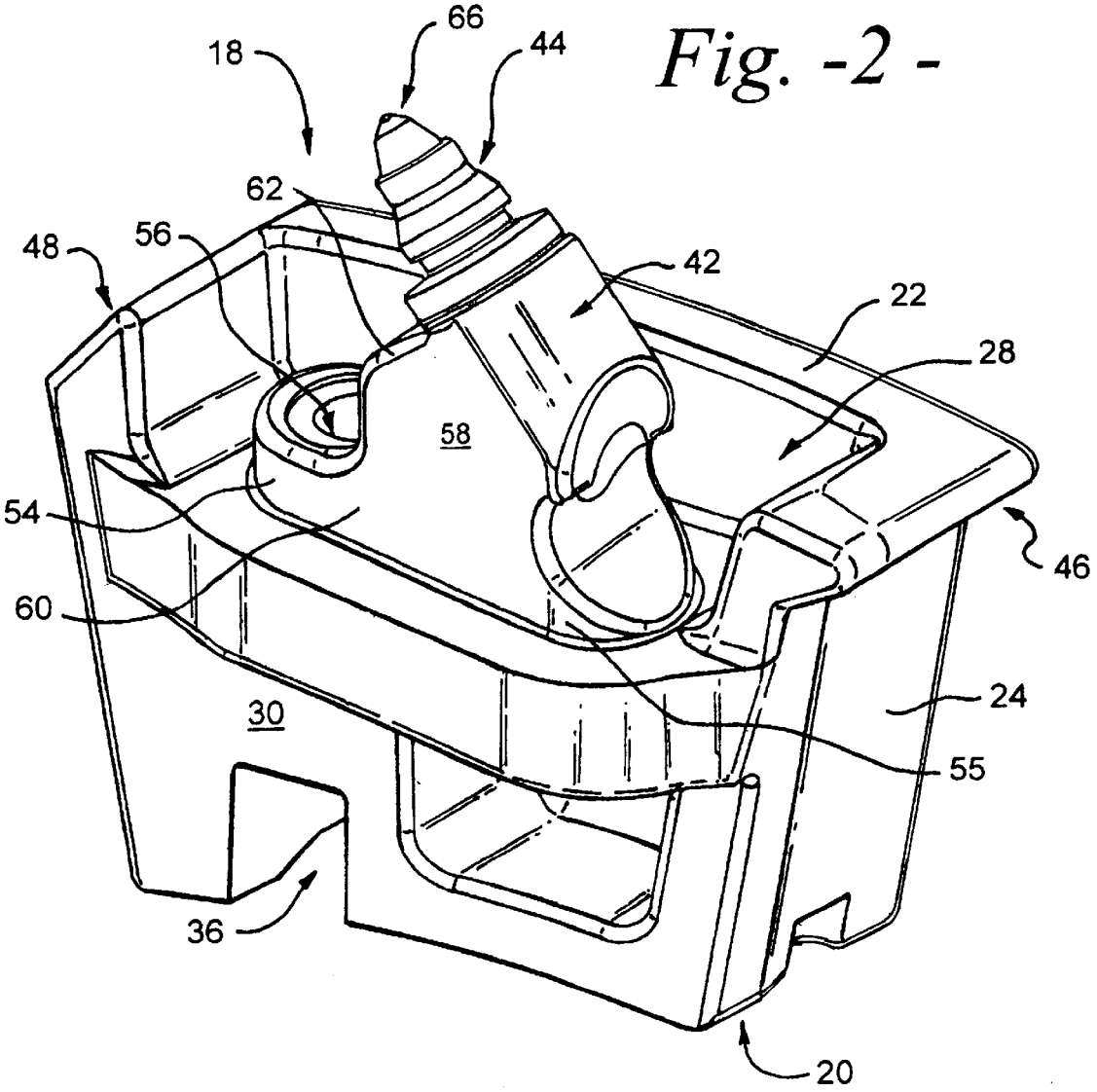
FIG. 2 is a perspective view of a flight from rearward and non-conveying sides showing a cutting tool and a tool holder, but without a fastener.
Figure 3:
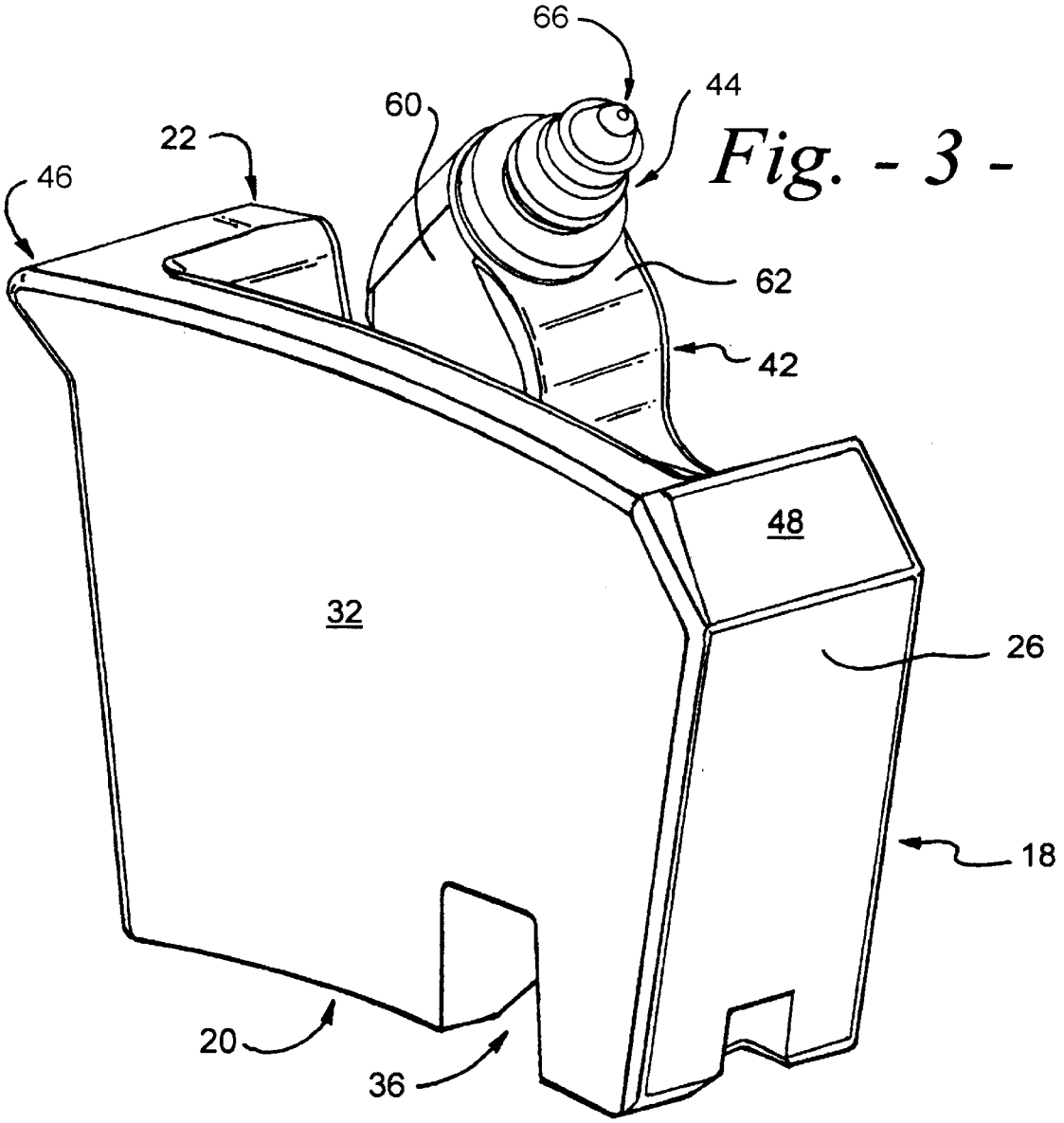
FIG. 3 is a perspective view of the flight from FIG. 2 from forward and conveying sides.
Figure 4:
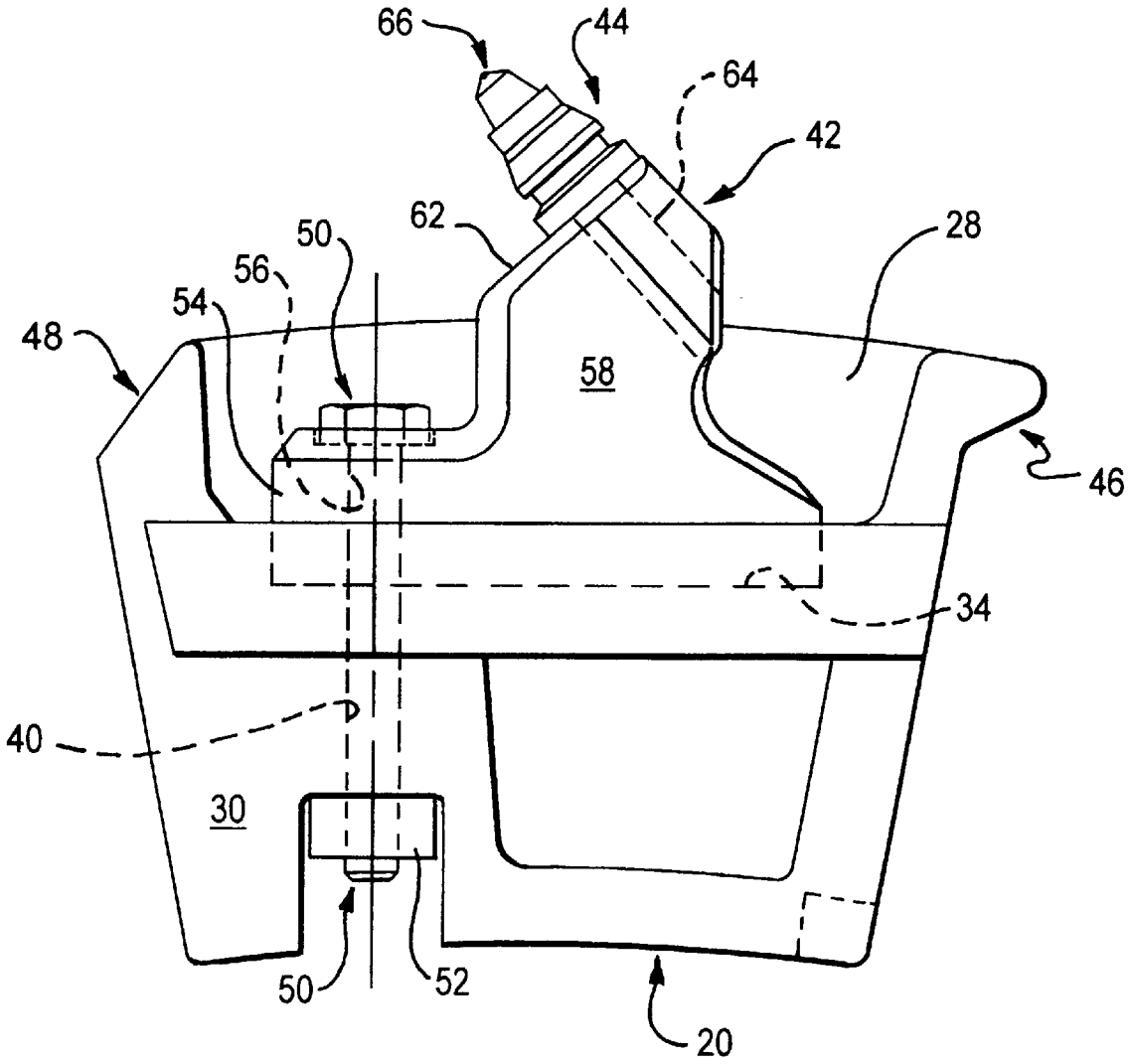
FIG. 4 is a non-conveying side view of a flight showing a tool holder, a cutting tool, a bolt and a nut.

In the preferred embodiment of the present invention, the rotary cutter 10 has a plurality of flights 18 that are individually attached to the outer surface 14 of the drum 12. As best shown in FIGS. 2, 3 and 4, each flight also has forward and rearward wall surfaces 26, 24 which are matingly engaged with corresponding wall surfaces 24, 26 on abutting flights 18. Each flight 18 also has an inner wall surface 20 and a radially spaced outer wall surface 22. The inner wall surface 20 is curved to match the curvature of the outer surface 14 of the drum 12. The flight 18 is preferably attached to the drum outer surface 14 by welding.

Each flight 18 has inner and outer radially spaced wall surfaces 20,22 and a tool holder receiving pocket 28 extending radially inwardly from the outer wall surface 22. The outer wall surface 22 and forward and rearward end walls 26,24 cooperate to define a portion of an open-sided tool holder receiving pocket 28 on flight 18. At the innermost part of the receiving pocket 28 is a recessed, form-fitting tool holder mounting socket 34. The socket 34 has generally parallel socket side walls 38 and arcuate socket end walls 39 which hold the tool holder 42 at a secure, predetermined angle to the longitudinal axis 16.

Each flight 18 also has a pair of side walls 30,32 that extend radially outwardly from the inner wall surface 20 to the outer wall surface 22. At least one of the side walls, identified as side wall 32 in FIG. 3, forms a material conveying surface for moving cut material in a predetermined direction in response to rotation of the drum 12. The flights 18 are attached to the outer surface 14 of the drum 12 in an aligned, abutting relationship. The material conveying surfaces 32 thereby provide a substantially continuous surface cooperating with the outer surface 14 of the drum 12 to provide a screw conveyor for moving cut material In a direction along the longitudinal axis 16. As can be seen from FIG. 1, material disposed in the channels formed by the flights and the drum surface will move toward the center of the drum along the axis 16 in response to counterclockwise rotation of the drum. In many machines of the type using the rotary cutter embodying the present invention, a conveyor is carried on the machine to transfer material from a longitudinally central area of the drum. In another arrangement, the flights may be arranged to move material from the one end of the drum to another end. For example, the flights at the opposite end (right end) of the drum are provided with a pitch consistent with that of the left end so that the cut material is moved in a direction toward the right area of the drum.

Each flight 18 also has a passage 36 that extends between the pair of side walls 30,32 and an opening 40 that extends radially inwardly from the tool holder receiving pocket 28 to the passage 36. This passage allows access to a nut 52, such as that used with a bolt (fastener) 50.

A tool holder 42 sits in the tool holder mounting socket 34. The holder 42 has a body 58 with generally parallel side portions 60 and arcuate forward and rearward portions 54,55. Additionally, the holder 42 has an upstanding boss 62 on the body 58 with an inclined cylindrical shaft 64. The shaft 64 receives a replaceable cutting tool 44 such as a carbide bit, and holds the bit's cutting end 66 spaced from the body 58. The forward portion 54 has a radially extending fastener-receiving hole 56 directly above the opening 40 in the mounting socket 34. A fastener 50, such as a bolt, passes through the fastener-receiving hole 56 and opening 40 and is secured in place with a nut 52.

Advantageously, a wedge-shaped boss 46 at the intersection of the outer wall surface 22 and rearward wall surface 24 extends over a contour-matching beveled edge 48 located at the intersection of the outer wall surface 22 and forward wall surface 26 on an abutting flight. The boss 46 protects underlying welds of abutting flights 18 to each other.

In operation, if the tool holder 42 should be broken, damaged or otherwise require replacement, the fastener 50 can be loosened and the tool holder and fastener can be removed radially. The nut 52 can be removed through the passage 36. If the fastener 50 should become frozen in place, it may be cut by directing a thin pencil flame from a cutting torch to the nut 52 through the passage 36. After cutting, the nut 52 and lower end of the bolt 50 can be driven out by striking the nut 52 with a punch inserted through the passage 36.

Industrial Applicability

The rotary cutter 10 embodying the present invention is particularly useful on roadway planers or milling machines and road reclaiming machines. In particular, the tool holder 42 is well-secured and maintained in proper alignment by the mounting socket 34 and fastener 50. Additionally, the fastener 50 is protected from direct rubbing contact with the working medium (asphalt, etc.) in the recessed tool holder receiving pocket 28 while the tool holder 42 itself is similarly protected over most of its profile. The placement of the fastener 50 at the forward portion 42 of the tool holder 42 ensures that the fastener 50 will remain in continuous tension, which is more desirable than having a fastener alternate between tensile and compressive loading.

Furthermore, the primary structural components of the rotary cutter arrangements, i.e., the flights 18 and the tool holder 42 are economically formed by casting or forging. If damaged during operation, the flights 18 may be repaired by replacing only the damaged segment. If a tool holder 42 is damaged during operation it can, as explained above, be readily removed and replaced.

Another important feature is provided by recessing the tool holder 42, and even a portion of the cutting tool 44 itself, radially inwardly from the outer wall surface 20 of the flight 18. This arrangement advantageously provides more available flight surface for increased material conveying capacity.

Thus it can be seen that the rotary cutter embodying the present invention provides significant structural, economic, operational and repairability advantages over presently known rotary cutter arrangements.

Other aspects, objects and advantages of this invention can be obtained from a study of the drawings, the disclosure, and the appended claims.

We claim:

1. A rotary cutter comprising:

a drum having an outer surface and being rotatable about a longitudinal axis;

a plurality of flights, each flight attached to said drum outer surface, and each flight having forward and rearward end wall surfaces each matingly engaged with a corresponding surface on an abutting flight, inner and outer radially spaced wall surfaces, a tool holder receiving pocket extending radially inwardly from said outer wall surface and including a tool holder mounting socket at the innermost portion thereof, a pair of side walls extending radially outwardly from said inner wall surface to said outer wall surface, at least one wall of said pair of side walls defining a material conveying surface, a passage extending between said pair of side walls, and an opening extending radially inwardly from said tool holder receiving pocket to said passage;

a tool holder having a forward portion relative to the rotation of said drum, said forward portion having a radially inwardly disposed fastener-receiving hole in communicating relationship with the radially inwardly disposed opening in said flight, said tool holder being closely received in said tool holder mounting socket; and a fastener passing through the fastener-receiving hole and the flight opening.

2. A rotary cutter as set forth in claim 1, said rearward end wall surface having an extended wedge-shaped boss at the intersection of said outer wall surface.

3. A rotary cutter as set forth in claim 1, wherein said forward end wall surface has a beveled edge at the intersection of said outer wall surface.

4. A flight for a rotary cutter comprising: forward and rearward end wall surfaces each adapted to be matingly engaged with a corresponding surface on an adjacent flight, inner and outer spaced wall surfaces, a tool holder receiving pocket extending inwardly from the outer wall surface and including a tool holder mounting socket at the innermost portion thereof, the socket having generally parallel socket side walls and arcuate socket end walls, said flight having a pair of side walls extending outwardly from the inner wall surface to the outer wall surface, one wall of said pair of side walls defining a material conveying surface, a passage extending between the pair of side walls, and an opening extending from the tool holder mounting socket to the passage, a wedge-shaped boss at the intersection of the rearward end wall surface and the outer wall surface and a beveled corner at the intersection of the forward end wall surface and the outer wall surface.

* * * * *